United States Patent [19]

Loane, Jr.

[11] 4,419,131

[45] Dec. 6, 1983

[54] FLUX FOR CONTINUOUS CASTING

[75] Inventor: Charles M. Loane, Jr., Bel Air, Md.

[73] Assignee: Mobay Chemical Corporation, Pittsburgh, Pa.

[21] Appl. No.: 263,645

[22] Filed: May 14, 1981

[51] Int. Cl.[3] ..... C22B 9/10

[52] U.S. Cl. ..... 75/257; 75/53; 148/26

[58] Field of Search ..... 75/53, 257; 148/26

[56] References Cited

U.S. PATENT DOCUMENTS

| | | | |
|---|---|---|---|
| 3,649,249 | 3/1972 | Halley et al. | 75/96 |
| 3,704,744 | 12/1972 | Halley et al. | 164/82 |
| 3,788,840 | 1/1974 | Koenig et al. | 75/94 |
| 3,899,324 | 8/1975 | Corbett | 75/94 |
| 3,926,246 | 12/1975 | Corbett et al. | 164/56 |
| 3,984,236 | 10/1976 | Koenig et al. | 75/94 |
| 4,204,864 | 5/1980 | Loane, Jr. et al. | 75/257 |
| 4,248,631 | 2/1981 | More | 75/257 |

FOREIGN PATENT DOCUMENTS

| | | |
|---|---|---|
| 18633 | of 0000 | European Pat. Off. . |
| 2024046 | of 0000 | United Kingdom . |

*Primary Examiner*—P. D. Rosenberg

*Attorney, Agent, or Firm*—Gene Harsh; Joseph C. Gil; Lyndanne M. Whalen

[57] ABSTRACT

A granular flux is made by intimately mixing a particulate glass frit with carbon black. The glass frit typically employed has a particle size distribution such that substantially all of the frit material has a particle size within the range of 0.5 to 4 mm. The carbon black is included in the flux in an amount of from 1 to 10 wt. %, based on the amount of the frit used. The disclosed flux is characterized by good flowability and its ability to remain mixed during transport.

6 Claims, No Drawings

FLUX FOR CONTINUOUS CASTING

BACKGROUND OF THE INVENTION

The present invention relates to a vitreous flux in which carbon is present and a process for making such a flux.

It is well known to apply a flux to the surface of a molten metal being cast. The flux is added to prevent oxidation of the melt, insulate the melt, lubricate the casting mold and remove deleterious materials (e.g., alumina) from the melt.

It is also known to include from 1 to 10 wt.% of powdered graphite in continuous casting flux products (see, e.g., U.S. Pat. Nos. 3,649,249 and 4,248,631) made from vitreous materials which have been ground to a particle such that at least 50% of the particles have a particle size less than 0.044 mm. The graphite is added to minimize heat loss from the surface of the molten metal. Graphite is easily mixed with powdery materials (e.g., finely ground vitreous materials); however, addition of such carbonaceous material to granular vitreous materials presents several practical problems. Premixing of the granular vitreous material and the carbonaceous material to form a flux in a location distant to the casting molds has been considered impractical because, during transport, the carbonaceous material settles and separates from the vitreous material. Mixing the carbonaceous powder with a material in the vicinity of the casting mold produces a carbon dust which may have a deleterious effect upon the metal being cast (particularly in the case of steel).

It is common practice to add carbon to a vitreous casting material shortly before the flux is applied to the molten mass. This approach is unsuitable with respect to a granular vitreous material which is to be used in an automated continuous casting process because, in such a continuous process, the flux material must be transported from storage to the caster. Such transporting of a mixture of granular vitreous particles and carbonaceous material results in a severe separation problem. While a sufficient degree of mixing might be maintained if the distance the flux were transported were sufficiently short, the carbon dust resulting from mixing in the vicinity could create problems in the metal being cast. Even if the degree of mixing could be preserved by adding excessive amounts of carbonaceous material, there is always the possibility that more than an acceptable amount of the unmixed excess would be added to the molten metal. Additionally, use of large amounts of carbon could result in the waste of an expensive starting material.

One approach to resolving these problems is that described in U.S. Pat. No. 4,248,631 (More et al.). More et al melts a silicate slag and then pours it into water to form a vitreous material. This vitreous material is then ground and screened to form relatively small particles. These particles are then superficially coated with carbon black and/or graphite with the aid of an adhesive material. This adhesive material is taught by More et al to be essential to achieve the appropriate degree of coating. In addition to increasing the cost of the product flux material, inclusion of such an adhesive material also makes it necessary to monitor the mixing operation to ensure that the slag material is exposed to enough adhesive to promote coating of the slag with an adequate amount of carbonaceous material. Care must also be taken during the mixing operation to prevent clumping of the carbonaceous material.

It would, therefore, be advantageous to have a carbon-containing flux material which could be easily produced at a location distant to the caster, stored (if necessary) and then transported to the caster either manually or automatically without significant separation of the carbonaceous material from the frit.

SUMMARY OF THE INVENTION

It is an object of the present invention to provide a carbon-containing flux material which may be transported without segregation of the carbonaceous material.

It is another object of the present invention to provide a flux material which may be used in an automated process for the continuous casting of a metal without substantial separation of the carbon from the granular vitreous frit.

It is also an object of the present invention to provide a process for the production of a carbon-containing flux material.

It is a further object of the present invention to provide a process for the production of a carbon-containing flux material in which little or no carbon dust is generated and in which no adhesive material is required.

It is another object of the present invention to provide a process for the production of a carbon-containing flux material which may be transported without segregation of the carbonaceous material.

These and other objects which will be apparent to those in the art are accomplished by mixing a granular vitreous frit with carbon black until the granular frit is coated with the carbonaceous material.

DETAILED DESCRIPTION OF THE INVENTION

The present invention relates to a carbon-containing granular vitreous flux and a process for making such a flux. Specifically, a particulate vitreous material is mixed with carbon black until the vitreous material is coated with substantially all of the carbonaceous material.

Particulate vitreous materials suitable to the practice of the present invention are known to those in the art. Appropriate vitreous materials include glass frits, such as those described in U.S. Pat. Nos. 3,649,249; 3,899,324; 3,926,246 and 3,704,744.

While the scope of the present invention is not limited to any specific vitreous material, the particle size of the vitreous material is a significant feature. The vitreous granular material should have a particle size distribution such that substantially all of the particles have a particle size within the range of 0.5–4 mm. It is preferred that substantially all of the vitreous particles be within the range of 0.5 to 2.38 mm.

Carbon blacks suitable to the present invention are any of the finely divided forms of carbon made by the incomplete combustion or thermal decomposition of natural gas or petroleum oil. The principal types presently available are channel black, furnace black, lamp black and thermal black. Furnace black is the most preferred of those available because it does not contain the harmful (i.e., carcinogenic) materials present in many of the other forms of carbon black.

Commercially available carbon blacks are generally sold in pellet form with the pellets having an average diameter of from 1 to 5 mm. This material may be added to the vitreous particles either in pellet form or after the particle size has been reduced. The carbon black is generally included in an amount which is from 1–10 wt.% of the vitreous frit, preferably 1–5 wt.%.

After the carbon black and vitreous frit have been combined, these materials are mixed until substantially all of the carbon black coats the vitreous particles. Any method for combining two solid materials may be employed in the process of the present invention as long as a minimum shearing action is accomplished. Methods and apparatus suitable for such mixing are well known to those in the art.

The physical properties (e.g., melting point) of the flux of the present invention will, of course, depend upon the specific frit used. However, these physical properties are not deleteriously affected by mixing with carbon black in accordance with the present invention. Fluxes made in accordance with the present invention are characterized by good flowability and little or no separation of carbon from the frit during motion. Additionally, little or no carbon dust is generated during the mixing operation.

Having thus described my invention, the following Examples are given by way of illustration.

EXAMPLES

The granular vitreous casting flux used in Examples 1–10 had the following particle size distribution:

TABLE A

| Particle Size Distribution Range (mm) | | Cumulative | | Cumulative |
|---|---|---|---|---|
| 2.38–1.68 | 26% | 26% | 15% | 15% |
| 1.68–1.19 | 36% | 62% | 29% | 44% |
| 1.19–0.84 | 23% | 85% | 29% | 73% |
| 0.84–0.5 | 14% | 99% | 27% | 100% |
| 0.5–0.354 | 1% | 100% | — | — |

EXAMPLE 1

0.45 gram of carbon black having a particle size of −325 mesh (U.S. Sieve) was mixed with 15 grams of a granular frit having the particle size distribution given in Table A. This mix was then agitated on a paint-shaker for five minutes.

The product mix was well coated and no settling or dusting was observed. The extent of coating was easily ascertainable visually because the uncoated frit was clear while the coated frit was black.

EXAMPLE 2

The procedure of Example 1 was repeated with the exception that 0.75 gram of carbon black was used. The product mix was well coated and no settling or dusting was observed.

EXAMPLES 3–4 (Comparison Examples)

The procedures of Examples 1 and 2 were repeated using flake graphite instead of carbon black. The flake graphite had the following particle size distribution:

| Particle Size (mm) | | Cumulative |
|---|---|---|
| 0.25 | 3% | 3% |
| 0.149 | 11% | 14% |
| 0.074 | 59% | 73% |
| 0.044 | 17% | 90% |
| <0.044 | 10% | 100% |

In both samples, the flake graphite did not adhere to the frit granules, and severe segregation occurred with nearly all of the graphite settling to the bottom.

EXAMPLES 5–6 (Comparison Examples)

The procedures of Examples 1 and 2 were repeated using ground anthracite coal rather than carbon black. The ground coal had the following particle size distribution:

| Particle Size (mm) | | Cumulative |
|---|---|---|
| 0.25 | 0% | 0% |
| 0.149 | 1% | 1% |
| 0.074 | 2% | 3% |
| 0.044 | 60% | 64% |
| <0.044 | 36% | 100% |

In each of these samples, the ground anthracite coal did coat the frit particles to some degree but the coal did not cling to the frit particles and a deleterious amount of dusting occurred.

EXAMPLES 7–8 (Comparison Examples)

The procedures of Examples 1 and 2 were repeated using ground metallurgical coke rather than carbon black. The ground coke had the following size distribution:

| Particle Size (mm) | | Cumulative |
|---|---|---|
| 0.25 | 0% | 0% |
| 0.149 | 1% | 1% |
| 0.074 | 14% | 15% |
| 0.044 | 55% | 69% |
| <0.044 | 31% | 100% |

In each of these samples, the ground coke did coat the particles to some degree but the coke did not cling to the frit particles and a significant amount of dusting occurred.

EXAMPLE 9 (Comparison Example)

0.3 gram of anthracite coal having an average particle size less than 0.044 mm was mixed with the frit described in Table A by the procedure described in Example 1. The product was examined under a microscope at 40X. Some of the carbon was found to adhere to the glass particles; however, a significant amount of the carbon remained unattached.

EXAMPLE 10 (Comparison Example)

The procedure of Example 9 was repeated using flake graphite having an average particle size less than 0.044 mm instead of coal. Very little of the graphite adhered to the glass particles.

EXAMPLE 11

The granular frit employed in this procedure had the following particle size distribution:

| | |
|---|---|
| 2.38–1.68 mm | 0.3% |
| 1.68–1.19 mm | 15.3% |
| 1.19–0.84 mm | 32.0% |
| 0.84–0.5 mm | 43.8% |
| 0.5–0.354 mm | 5.0% |

1250 pounds of this frit were mixed with 25 pounds (2 wt.%) of carbon black (−325 mesh U.S. Sieve) in a commercial ribbon blender for seven minutes. The thus-formed flux material was then used in casting 100 tons of aluminum-killed steel. The steel was cast into a slab of 915 by 230 mm at a casting rate of 48 inches per minute.

The steel cast had excellent surface quality. The flux material was found to be particularly advantageous in that no carbon dust was present in the casting environment, the flux melted uniformly and no mold powder build up in the pouring tube or on the mold wall was observed.

It will be understood that the above description of the present invention is susceptible to various modifications, changes and adaptations and the same are intended to be comprehended within the meaning and range of equivalents of the appended claims.

What is claimed is:

1. A process for the production of granular flux comprising mixing a particulate glass frit and carbon black until the frit particles are coated with substantially all of the carbon black wherein substantially all of the particulate glass frit has a particle size within the range of 0.5 to 4 mm.

2. The process of claim 1 wherein substantially all of the particulate glass frit has a particle size within the range of 0.5 to 2.38 mm.

3. The process of claim 1 wherein the carbon black is furnace black.

4. A granulate carbon-coated flux comprising a stable mixture of a particulate glass frit and carbon black wherein the particulate glass frit has a particle size distribution such that substantially all of the particles have a particle size within the range of 0.5 to 4 mm.

5. The flux of claim 4 wherein the carbon black is furnace black.

6. The flux of claim 4 wherein substantially all of the particulate glass frit has a particle size within the range of 0.5 to 2.38 mm.

* * * * *